United States Patent [19]

Kupperman et al.

[11] 4,016,891

[45] Apr. 12, 1977

[54] DENTAL FLOSS HOLDER FOR DETACHABLE SECUREMENT TO TOOTHBRUSH HANDLE AND THE LIKE FOR SUPPORTING A STRIP OF FLOSS IN TAUT CONDITION READY FOR USE

[75] Inventors: Sam Kupperman, Chicago; Dennis I. Kupperman, Glenview, both of Ill.

[73] Assignee: R B Toy Development Co., Skokie, Ill.

[22] Filed: July 17, 1975

[21] Appl. No.: 596,735

[52] U.S. Cl. ..... 132/84 A

[51] Int. Cl.[2] ..... A45D 44/18

[58] Field of Search ..... 132/84 A, 91, 92

[56] References Cited

UNITED STATES PATENTS

| | | | |
|---|---|---|---|
| 1,537,853 | 5/1925 | Mason | 132/84 A |
| 2,233,936 | 3/1941 | Campbell | 132/84 A |
| 2,517,806 | 8/1950 | Steiler | 132/91 |
| 3,850,182 | 11/1974 | Clark, Jr. | 132/92 R |

*Primary Examiner*—G.E. McNeill

*Attorney, Agent, or Firm*—Prangley, Dithmar, Vogel, Sandler & Stotland

[57] ABSTRACT

A dental floss holder for supporting a strip or length of dental floss in position ready for use which comprises a forked member having a pair of spaced arms and an extension at the inner end of the forked member. A dental floss strip of a prescribed length is strung on the holder so that the opposite ends of the strip are adjacent the extension, with a portion of the strip extending between the spaced arms. The extension is adapted to be detachably secured to the end of a handle which is part of a toothbrush, with the opposite ends of the strip being held locked between the extension and the handle end and with the portion of the strip between the arms maintained in a tensioned and taut condition. The extension may be in the form of a socket which receives the end of the handle. In another version the socket receives a sleeve which locks the opposite ends of the strip in a secured and taut position before the dental floss holder is secured to the end of the handle.

3 Claims, 9 Drawing Figures

FIG. 3
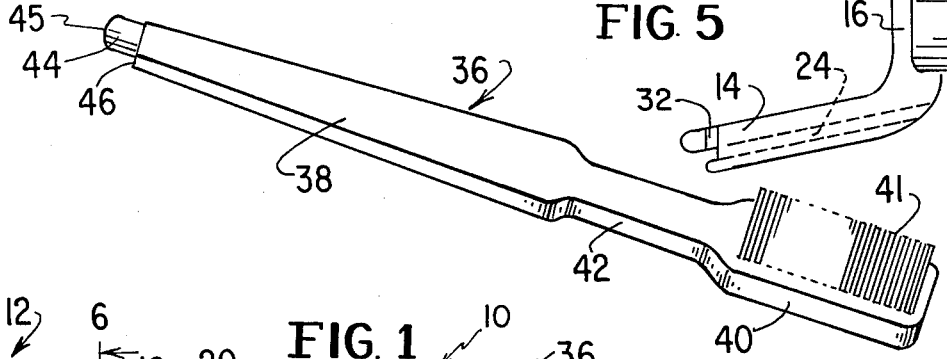
FIG. 5
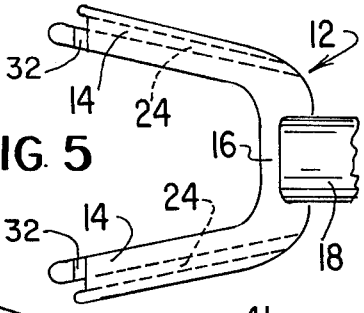
FIG. 1
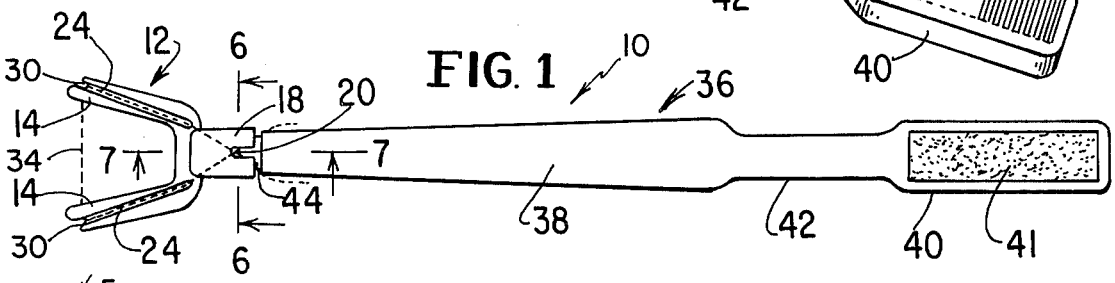
FIG. 2
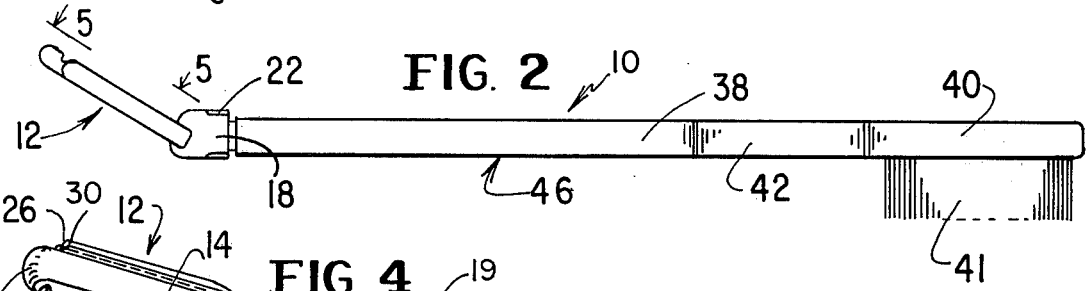
FIG. 4
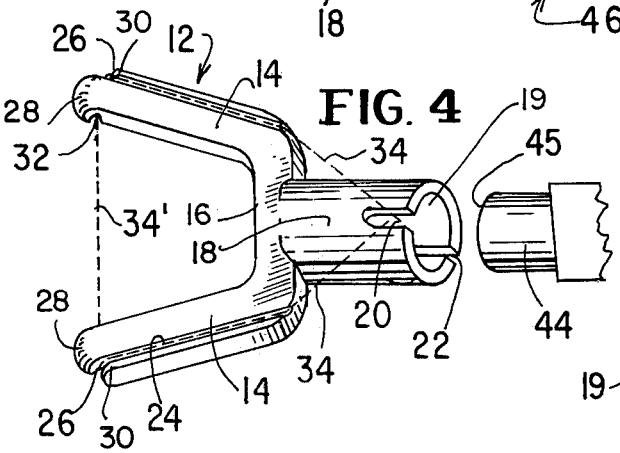
FIG. 7
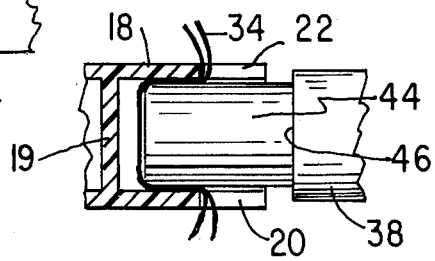
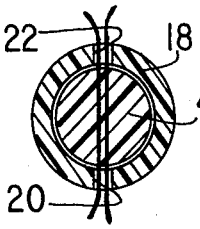
FIG. 6
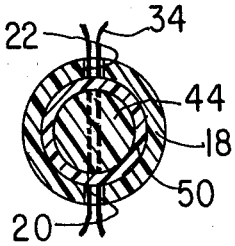
FIG. 9
FIG. 8
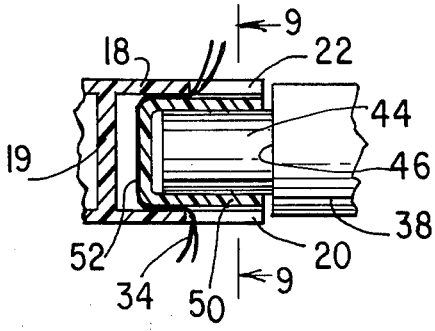

DENTAL FLOSS HOLDER FOR DETACHABLE SECUREMENT TO TOOTHBRUSH HANDLE AND THE LIKE FOR SUPPORTING A STRIP OF FLOSS IN TAUT CONDITION READY FOR USE

BRIEF SUMMARY OF THE INVENTION

One of the objects of this invention is to provide a dental floss holder for supporting a strip or length of dental floss on the holder in a ready for use position, the holder being detachably secured to the handle of a toothbrush and the like.

Another object of this invention is to provide a forked holder on which a strip or length of dental floss is strung so that said holder is readily attachable to the end of the handle, which may be part of a toothbrush or the like, so that the toothbrush and dental floss are each retained in position ready for use.

Another object of this invention is to provide a dental floss holder having a prestrung dental floss thereon, whereby when same is attached to the handle the floss is held in taut and tensioned condition and will not slacken during use.

Another object of this invention is to provide a dental floss holder prestrung with a strip or length of dental floss in position ready for use, whereby the floss is secured and locked in a taut and tensioned condition on the holder and where the holder is readily secured to the handle of a toothbrush or the like.

Another object of this invention is to provide a dental floss holder in which the dental floss may be either prestrung on the holder and readily attached to a handle or in which the user strings the dental floss on the holder and when same is attached to the handle the floss is tensioned and held taut so that it may be effectively used.

BRIEF DESCRIPTION OF THE DRAWINGS

In the drawings:

FIG. 1 is a front plan view of the invention attached to a toothbrush.

FIG. 2 is a side elevational view of FIG. 2.

FIG. 3 is a view of the toothbrush with the rear end of the handle constructed to receive the dental floss holder.

FIG. 4 is an exploded view of the dental floss holder and the end of the handle to which it is applied.

FIG. 5 is a rear elevational view of the dental floss holder taken on line 5—5 of FIG. 2.

FIG. 6 is an enlarged sectional view taken on line 6—6 of FIG. 1.

FIG. 7 is an enlarged view partly in section taken on line 7—7 of FIG. 1.

FIG. 8 is an enlarged sectional view of a modification taken on lines similar to that of FIG. 7; and FIG. 9 is a sectional view taken on line 9—9 of FIG. 8.

The dental floss holder forming this invention is preferably associated with a toothbrush and is thus shown. The dental floss holder is generally indicated at 10 and comprises a forked member generally indicated at 12 which includes a pair of spaced diverging arms of members 14 connected at their inner ends by an intermediate member 16 to form a generally U-shaped configuration. Extending outwardly of the intermediate member 16 is a short tubular extension 18 having an inner end wall 19. The extension 18 forms a socket for receiving the end of the handle, to be hereinafter described. The tubular extension 18 is provided with a pair of diametrically opposed front and rear slots 20 and 22, respectively, at the mouth thereof. The forked member 12 inclines rearwardly of the tubular extension 18 at an angle of approximately 30°, as best seen in FIG. 2, so that the forked member 12 when positioned on the handle of the toothbrush is offset rearwardly from the longitudinal plane of the handle.

Each of the arms 14 has a longitudinally extending groove 24 on the front side which is inclined inwardly from the outer end toward the inner end to receive the strung dental floss, as will be subsequently explained. The top or upper end 26 of the arm adjacent the outer side terminates short of the top or upper end 28 of the arm so that each longitudinal groove continues around the radius at the top or upper end of the arm, to thereby form a notched portion 30 at the top of each of the arms for receiving the strung floss. A cross or transversely extending groove 32 is formed on the rear side of each of the arms adjacent the top end to receive the floss and hold it in position as it extends between the arms.

The dental floss 34 is supplied in defined lengths or strips and the strip is attached to the dental floss holder in the following manner. The strip of floss 34 is folded in half and one end of the strip is positioned adjacent the front slot 20 of the tubular extension 18, then the floss is positioned to lie in the longitudinal groove 24 of one arm and around the end notch 30 and then passed rearwardly to lie on the cross groove 32 of the arm and then positioned to extend across as at 34' to the other arm and positioned around the rear cross groove 32 of said other arm and then forwardly to extend down over the notch 30 and down the face of the other arm to lie in the longitudinal groove 24. The other end of the strip of floss is also positioned adjacent the front slot 20 of the tubular extension 18. The opposite ends of each strip will be adjacent each other at the front slot 20 but will extend below the mouth of the tubular extension or socket 18 and same is ready for attachment to the handle of the toothbrush.

The toothbrush generally indicated at 36 comprises a handle 38 and a head 40 to which the conventional bristles 41 are secured. A portion of the handle, indicated at 42, is of a reduced width. The rear end of the handle has a reduced annular stem 44 having a flat end wall 45. The reduced stem 44 provides a shoulder 46. The front and rear sides of the handle are indicated at 46 and 47, respectively. The tubular extension 18 of the floss holder 12 is detachably secured to the stem 44, as will be now explained.

When attaching the dental floss holder to the stem 44 of the toothbrush, the tubular extension or socket 18 of the holder 12 is slipped on to the annular stem 44 of the handle and in slipping same thereon the opposite ends or terminals of the floss which are both positioned adjacent the front slot 20 will both be folded inwardly through the front slot 22 into the tubular extension or socket 18 and will extend over the end 45 of the stem 44 and will fold downwardly toward the rear slot 22 and outwardly thereof, as shown in FIGS. 6 and 7. As the tubular extension or socket 18 is pressed inwardly toward the shoulder 46, the strip of floss 34 which is now trapped inside the tubular socket 18 will be pushed so that the portions of the strip on the flat end 45 of the stem will be urged inwardly against the inner wall of the socket 18 and will be locked between the end 45 of the stem and the inner wall 19 of the socket 18, as well as along the opposite sides, as shown in FIG. 7. This movement causes the floss 34 extending between the arms to be held in a taut or tensioned position so that it can be used in the manner well-known.

The dental floss holder can be retained on the toothbrush and cleaned after use by rinsing with water and can be used again for at least several times, or the entire floss holder 12 can be replaced with another floss holder with the floss strung thereon in the manner previsouly described. In lieu of providing a supply of such floss holders with floss strung thereon, the floss may be provided in strips of defined length and the user can apply each strip as desired to the floss holder in the manner heretofore described.

The floss holder with the floss positioned thereon as described may be packaged so that a plurality of such holders and assembled floss strips are ready for use.

FIGS. 8 and 9

The modification shown in FIGS. 8 and 9 is particularly applicable when it is desired to prestring the floss on the holder and to prevent the prestrung floss from being dislodged or pulled off of the floss holder before the holder is applied to the stem of the handle. A floss holder similar to that previously described is utilized and hence will not be redescribed. The tubular extension thereof only is shown and it is identified as 18. The only addition in this modification is a short tubular sleeve indicated at 50 which is inserted into the tubular extension or socket 18 of the floss holder so that it maintains the floss in a secured and unslidable position with respect to the floss holder before the holder is inserted on the stem 44 of the handle. As best seen in FIG. 8, the floss will extend through the front slot 20 and into the tubular socket 18 and over the inner end 52 of the sleeve and then downwardly and outwardly through the rear slot 22. The floss will be trapped between the end wall 52 of the sleeve and the inner wall 19 of the tubular socket 18 and will be held in a captive position against dislodgement from the floss holder. When it is desired to use the floss holder 12 it is then inserted on the stem 44 of the handle, as shown in FIG. 8. When using the tubular sleeve as in FIG. 8, the stem 44 of the handle is of a reduced diameter from that shown in FIG. 7. The floss holder together with the prestrung floss thereon and locked in position by means of the sleeve can be packaged and sold with a plurality of such units in a single package, each to be used as desired, or the strips of dental floss can be sold in a package and be strung by the user.

What is claimed is:

1. In combination a handle supporting a toothbrush at one end and means for supporting a precut strip or length of dental floss in position ready for use at the opposite end, said means comprising a forked member having a pair of spaced diverging arms and a tubular extension at the inner end of said forked member forming a socket and in which the socket has a slot at the mouth thereof, said spaced arms extending rearwardly of said tubular extension and at an inclined plane with respect to said extension with each of said arms having a longitudinal groove on one of the surfaces and a transversely extending groove on the undersurface, a precut dental floss strip adapted to be strung on said forked member and to extend into the longitudinal and transverse grooves of said arms and extend between said arms with the opposite ends of said strip adjacent the tubular extension, said tubular extension adapted to be detachably secured to the end of said handle, with the opposite ends of said strip being held locked within said socket between said tubular extension and said handle end with at least one of the opposite ends of said strip passing through said slot and with the portion of the strip between the arms maintained in a tensioned and taut condition, said forked member inclined at an angle with respect to the longitudinal plane of the handle.

2. A structure as set forth in claim 1 in which the tubular socket has diametrically opposed front and rear slots adjacent the mouth of the socket into which the opposite ends of the strip of dental floss are passed into and out of the socket when same is positioned on the end of the handle.

3. A structure as set forth in claim 1 in which a sleeve fits within said tubular socket to retain the opposite ends of said dental floss strip and in which the end of the handle is round and is received within the tubular socket and the sleeve.

* * * * *